US009405270B2

(12) United States Patent
Ogawa et al.

(10) Patent No.: US 9,405,270 B2
(45) Date of Patent: Aug. 2, 2016

(54) FIXING DEVICE AND IMAGE FORMING APPARATUS INCORPORATING SAME

(71) Applicants: Tadashi Ogawa, Tokyo (JP); Kenji Ishii, Kanagawa (JP); Teppei Kawata, Kanagawa (JP); Arinobu Yoshiura, Kanagawa (JP); Toshihiko Shimokawa, Kanagawa (JP); Kensuke Yamaji, Kanagawa (JP); Yuji Arai, Kanagawa (JP); Yoshiki Yamaguchi, Kanagawa (JP); Hiromasa Takagi, Tokyo (JP); Naoki Iwaya, Tokyo (JP); Takahiro Imada, Kanagawa (JP); Hajime Gotoh, Kanagawa (JP); Akira Suzuki, Tokyo (JP); Masaaki Yoshikawa, Tokyo (JP)

(72) Inventors: Tadashi Ogawa, Tokyo (JP); Kenji Ishii, Kanagawa (JP); Teppei Kawata, Kanagawa (JP); Arinobu Yoshiura, Kanagawa (JP); Toshihiko Shimokawa, Kanagawa (JP); Kensuke Yamaji, Kanagawa (JP); Yuji Arai, Kanagawa (JP); Yoshiki Yamaguchi, Kanagawa (JP); Hiromasa Takagi, Tokyo (JP); Naoki Iwaya, Tokyo (JP); Takahiro Imada, Kanagawa (JP); Hajime Gotoh, Kanagawa (JP); Akira Suzuki, Tokyo (JP); Masaaki Yoshikawa, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 13/752,679

(22) Filed: Jan. 29, 2013

(65) Prior Publication Data

US 2013/0209139 A1 Aug. 15, 2013

(30) Foreign Application Priority Data

Feb. 9, 2012 (JP) ..... 2012-026354

(51) Int. Cl.
*G03G 21/16* (2006.01)
*G03G 15/20* (2006.01)

(52) U.S. Cl.
CPC ..... *G03G 21/1685* (2013.01); *G03G 15/2053* (2013.01); *G03G 2215/2035* (2013.01)

(58) Field of Classification Search
CPC . G03G 15/20; G03G 15/206; G03G 15/2064; G03G 15/2089; G03G 21/1685
See application file for complete search history.

(56) References Cited

U.S. PATENT DOCUMENTS

| | | | | |
|---|---|---|---|---|
| 7,235,761 | B1 * | 6/2007 | Maul et al. | 219/216 |
| 8,032,069 | B2 * | 10/2011 | Shin et al. | 399/329 |
| 2003/0007813 | A1 | 1/2003 | Yasui et al. | |
| 2003/0165348 | A1 | 9/2003 | Amita et al. | |
| 2004/0013453 | A1 | 1/2004 | Shinshi et al. | |
| 2004/0179875 | A1 | 9/2004 | Iwata et al. | |

(Continued)

FOREIGN PATENT DOCUMENTS

| | | |
|---|---|---|
| JP | 4-044075 | 2/1992 |
| JP | 6-003982 | 1/1994 |

(Continued)

OTHER PUBLICATIONS

U.S. Appl. No. 13/557,841, filed Jul. 25, 2012, Toshihiko Shimokawa, et al.

(Continued)

*Primary Examiner* — Clayton E Laballe
*Assistant Examiner* — Ruifeng Pu
(74) *Attorney, Agent, or Firm* — Harness, Dickey & Pierce, P.L.C.

(57) ABSTRACT

A fixing device capable of incorporating in an image forming apparatus includes a belt unit including a rotatable elastic endless belt having a sleeve shape without a driving shaft and a nip forming member disposed contactable against an inner surface of the endless belt, and a pressing member to form a nip contact portion through which a recording medium passes by pressing against the nip forming member via the endless belt. The endless belt is configured to be removable from the fixing device without contacting the endless belt.

20 Claims, 7 Drawing Sheets

(56) References Cited

U.S. PATENT DOCUMENTS

2005/0074251 A1 4/2005 Katoh et al.
2005/0129432 A1 6/2005 Sato et al.
2005/0163543 A1 7/2005 Satoh et al.
2006/0029411 A1 2/2006 Ishii et al.
2006/0116230 A1 6/2006 Satoh et al.
2006/0133868 A1* 6/2006 Kobayashi et al. ..... 399/328
2006/0165429 A1 7/2006 Satoh et al.
2006/0165443 A1 7/2006 Yoshinaga et al.
2006/0177232 A1 8/2006 Ehara et al.
2006/0285893 A1 12/2006 Ishii
2007/0014600 A1 1/2007 Ishii et al.
2007/0014603 A1 1/2007 Satoh et al.
2007/0025754 A1 2/2007 Takagi et al.
2007/0059011 A1 3/2007 Seo et al.
2007/0166083 A1 7/2007 Satoh et al.
2007/0212089 A1 9/2007 Seo et al.
2007/0242988 A1 10/2007 Seo et al.
2007/0280754 A1 12/2007 Ogawa et al.
2007/0292175 A1 12/2007 Shinshi
2008/0025772 A1 1/2008 Seo et al.
2008/0025773 A1 1/2008 Ito et al.
2008/0044196 A1 2/2008 Seo et al.
2008/0124152 A1 5/2008 Nishikawa et al.
2008/0219721 A1 9/2008 Ito et al.
2008/0226326 A1 9/2008 Seo et al.
2008/0232873 A1 9/2008 Ueno et al.
2008/0286018 A1* 11/2008 Lee ..... 399/329
2008/0317532 A1 12/2008 Ehara et al.
2009/0116884 A1 5/2009 Nonaka et al.
2009/0123201 A1 5/2009 Ehara et al.
2009/0148204 A1 6/2009 Yoshinaga et al.
2009/0263155 A1 10/2009 Murano
2010/0074667 A1 3/2010 Ehara et al.
2010/0290822 A1 11/2010 Hasegawa et al.
2010/0303521 A1 12/2010 Ogawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064443 A1 3/2011 Iwaya et al.
2011/0064450 A1 3/2011 Ishii et al.
2011/0064451 A1 3/2011 Yamaguchi et al.
2011/0064490 A1 3/2011 Imada et al.
2011/0064502 A1 3/2011 Hase et al.
2011/0076071 A1 3/2011 Yamaguchi et al.
2011/0085832 A1 4/2011 Hasegawa et al.
2011/0091253 A1 4/2011 Seo et al.
2011/0091254 A1* 4/2011 Shin ..... G03G 15/2064 399/333
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0176822 A1 7/2011 Ishii et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0211880 A1* 9/2011 Furukata et al. ..... 399/329
2011/0217056 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222876 A1 9/2011 Yuasa et al.
2011/0222888 A1 9/2011 Ikebuchi et al.
2011/0222926 A1 9/2011 Ueno et al.
2011/0222929 A1 9/2011 Fujimoto et al.
2011/0222930 A1 9/2011 Fujimoto et al.
2011/0222931 A1 9/2011 Shinshi et al.
2011/0229161 A1 9/2011 Ueno et al.
2011/0229162 A1 9/2011 Ogawa et al.
2011/0229178 A1 9/2011 Ogawa et al.
2011/0229181 A1* 9/2011 Iwaya ..... G03G 15/2039 399/69
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0229236 A1 9/2011 Ehara et al.
2011/0274453 A1 11/2011 Shimokawa et al.
2011/0311284 A1 12/2011 Seo et al.
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0148304 A1* 6/2012 Sugaya et al. ..... 399/122
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0177424 A1 7/2012 Saito et al.
2012/0201558 A1* 8/2012 Watanabe ..... 399/69
2012/0207523 A1 8/2012 Ueno et al.
2012/0219312 A1 8/2012 Yuasa et al.
2012/0224878 A1 9/2012 Ikebuchi et al.
2012/0237273 A1 9/2012 Yoshinaga et al.
2012/0269562 A1* 10/2012 Hashimoto ..... 399/338
2013/0108333 A1* 5/2013 Yasumoto ..... 399/303

FOREIGN PATENT DOCUMENTS

JP 8-262903 10/1996
JP 2001-005321 1/2001
JP 2007-334205 12/2007
JP 2008-033240 2/2008
JP 2009-042305 2/2009
JP 2009093141 A 4/2009
JP 2009-115969 5/2009
JP 2009-258457 A 11/2009
JP 2010-217209 9/2010
JP 2010-217210 9/2010
JP 2011-047995 3/2011

OTHER PUBLICATIONS

Office Action for corresponding Japanese application No. 2012-026354 dated Sep. 8, 2015.

* cited by examiner

FIXING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2012-026354, filed on Feb. 9, 2012, in the Japan Patent Office, the entire disclosure of which is hereby incorporated by reference herein.

BACKGROUND OF THE INVENTION

1. Field of the Invention

Embodiments of the present invention relate to a fixing device that fixes an image to a recording medium and an image forming apparatus, such as a copier, a printer, a facsimile machine and a multifunctional device having functions of the copier, printer, and facsimile machine, which includes the fixing device.

2. Description of the Related Art

In the image forming processes performed for known electrophotographic image forming apparatuses, an electrostatic latent image is formed on the surface of a photoconductor drum that serves as an image carrier, developed into a visible toner image by applying a developer thereto, transferred onto a recording medium by a transfer device, and fixed to the recording medium by applying pressure and heat in a fixing device.

The fixing device includes two opposed rollers, a roller and a belt, or a rotary body that is a combination of the rollers or the roller and the belt to sandwich the recording medium therebetween and apply heat and pressure for fixing the toner image to the recording medium. For example, a known belt fixing unit as illustrated in FIG. 1 includes a fixing roller 1B provided with a fixing belt 1J and a pressure roller 1A. The fixing belt 1J includes a heat roller 1D that has a heater 1F serving as a heat source, and the fixing belt includes the fixing roller 1B having a surface layer and a rubber layer. The pressure roller 1A is disposed in contact with the fixing belt 1B. After a recording medium 1H having the transferred toner image thereon has arrived at a fixing device 100, the recording medium 1H is conveyed to a fixing nip contact portion formed between the fixing belt 1J and the pressure roller 1A. In the process in which the recording medium 1H passes the fixing nip contact portion, the toner image transferred onto the recording medium 1H is heated and pressed.

For another example, Japanese Patent Application Publication No. H04-44075 (JP-H04-044075-A) discloses a fixing device 200 that can be used for an image forming apparatus and includes a fixed member that slidably contacts an inner surface of the fixing member, as illustrated in FIG. 2. This fixing device 200 includes a film heating system, in which a fixing nip contact portion is generally formed by sandwiching a fixing film made of heat-resistant film between a ceramic heater 2F serving as a heating element and a pressure roller 2A serving as a pressing member. A recording medium having an unfixed toner image is conveyed between the film and the pressure roller 2A at the fixing nip contact portion, and is further conveyed together with the film, so that heat of the ceramic heater 2F is applied at the fixing nip contact portion to the recording medium via the film. Further, the unfixed toner image is fixed to the surface of the recording medium by application of heat and the pressure exerted at the fixing nip contact portion.

The fixing device 200 employing the film heating system can include an on-demand type device using the ceramic heater 2F and a low heat capacity member such as the film, and can power up the ceramic heater 2F as a heat source in image formation of the image forming apparatus to ensure that the fixing device 200 is heated to the predetermined fixing temperature. Accordingly, a waiting period from power-on to standby for image formation is short (i.e., quick start) and power consumption during standby is greatly reduced.

For yet another example, Japanese Patent Application Publication No. H08-262903 (JP-H08-262903-A) discloses a fixing device employing a pressure belt. The fixing device includes a rotary heating/fixing roll whose surface is elastically deformed, an endless belt that is movable while it is contacting the heating/fixing roll, and a pressure pad that is non-rotatably disposed inside the endless belt to cause the endless belt to press against the heat fixing roller to form a belt nip contact portion between the endless belt and the heat fixing roller so that the recording medium can pass through the belt nip contact portion and can elastically deform the surface of the heat fixing roller. The fixing device using the pressure belt can increase the contact area of the heating/fixing roll with the recording medium, and therefore thermal conductivity of the fixing device can be enhanced and energy consumption can be reduced, thereby reducing the size of the fixing device and the image forming apparatus.

However, the fixing device disclosed in JP-H04-044075-A has insufficient wear resistance for sliding or moving between the ceramic heater 2F as the heat source and the inner surface of the endless belt 2J. For example, if the fixing device 200 is operated for an extended period of time, the inner surface of the endless belt 2J suffers wear due to the friction of contact of the ceramic heater 2F with the endless belt 2J, thereby serving to increase frictional resistance. Accordingly, the movement of the endless belt 2J becomes unstable or the drive torque of the fixing device 200 increases, adversely affecting conveyance of the recording media and causing image displacement. Further, stress on the driving gear can damage the gear train.

Further, the fixing device 200 employing the film heating system is configured to heat the belt at the nip contact portion locally. Therefore, when the belt rotates through the nip contact portion, the temperature of the endless belt 2J is at its lowest and the endless belt 2J has completely cooled down at the entrance to the nip contact portion, and therefore risk of fixing failure increases considerably. This effect becomes more pronounced when the endless belt 2J is rotated at higher speed.

Meanwhile, to improve slidability of the inner surface of the belt and the fixed member, JP-H08-262903-A discloses a configuration of the fixing device in which an outer circumferential surface of the pressure pad is formed as a layer of a fiberglass sheet impregnating polytetrafluoroethylene (a PTFE-impregnated glass cloth) as a low-friction sheet. JP-H08-262903-A describes that the slidability can be enhanced with this method. However, in the fixing device employing the above-described pressure belt, the fixing roller has a large heat capacity, and therefore the temperature of the fixing device does not elevate quickly, which results in a long warm-up time.

To address the above-described problems, the inventors of the present invention have studied the fixing device that is disclosed in Japanese Patent Application Publication No. 2007-334205 (JP-2007-334205-A). This fixing device discloses technology in which the entire part of a sleeve endless belt is heated by a heat source disposed inside the belt, thereby shortening a warm-up time of the fixing device. However, the sleeve endless belt includes the heat source therein and therefore does not have a drive shaft therein. With this configuration, the entire fixing unit needs to be replaced instead of just the endless belt, resulting in an increase in costs.

SUMMARY OF THE INVENTION

The present invention describes a novel fixing device including a belt unit including a rotatable elastic endless belt having a sleeve shape without a driving shaft and a nip forming member disposed contactable against an inner surface of the endless belt, and a pressing member to form a nip contact portion through which a recording medium passes by pressing against the nip forming member via the endless belt. The endless belt is configured to be removable from the fixing device without contacting the endless belt.

The above-described fixing device may further include a flange to hold the belt unit, and a belt unit stay to hold the flange. The belt unit may be configured to be removable by removing the belt unit stay.

The belt unit may include a heater therein to heat the endless belt, and the heater may be held by the belt unit stay.

The belt unit may further include a nip supporter to prevent deformation of the nip forming member due to pressure exerted by the pressing member. The nip supporter may be held by the belt unit stay.

The belt unit may include a nip supporter to prevent deformation of the nip forming member due to pressure exerted by the pressing member. The nip supporter may be held by the belt unit stay.

Further, a novel image forming apparatus includes an image carrier to form an image on a surface thereof, a transfer unit to transfer the image onto a recording medium, and the above-described fixing device.

BRIEF DESCRIPTION OF THE SEVERAL VIEWS OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION OF THE INVENTION

Figure 1:
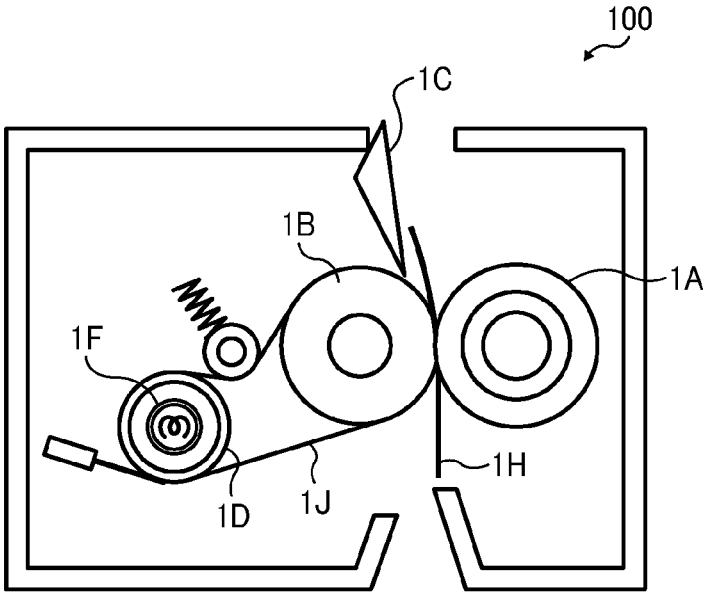
FIG. 1 RELATED ART
FIG. 1 is a schematic diagram illustrating a configuration of a known fixing device.
Figure 2:
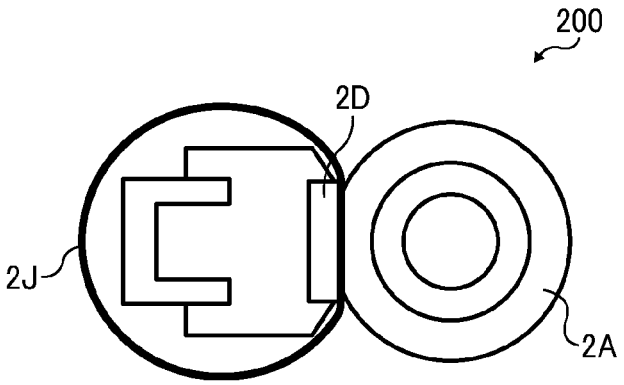
FIG. 2 RELATED ART
FIG. 2 is a schematic diagram illustrating a configuration of another known fixing device.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that have the same function, operate in a similar manner, and achieve a similar result.

Referring now to the drawings, wherein like reference numerals designate identical or corresponding parts throughout the several views, preferred embodiments of the present invention are described.

A description is give of a configuration of an image forming apparatus 1 according to a first embodiment of the present invention.

The image forming apparatus 1 that is a tandem-type color printer includes a toner bottle container 11 at an upper part thereof. The toner bottle container 11 contains four toner bottles 13Y, 13M, 13C, and 13K, which corresponds to respective single toner colors of yellow, magenta, cyan, and black. The toner bottles 13Y, 13M, 13C, and 13K are detachably attachable to the toner bottle container 11.

An intermediate transfer unit 85 is disposed below the toner bottle container 11. The intermediate transfer unit 85 includes an intermediate transfer belt 78 and image forming devices 4Y, 4M, 4C, and 4K disposed facing the intermediate transfer belt 78.

The image forming devices 4Y, 4M, 4C, and 4K include photoconductive drums 5Y, 5M, 5C, and 5K, respectively. Further, a charging device 75Y, a development device 76Y, a cleaning unit 77Y, and a non-illustrated discharging unit are arranged around the photoconductive drum 5Y; a charging device 75M, a development device 76M, a cleaning unit 77M, and a non-illustrated discharging unit are arranged around the photoconductive drum 5M; a charging device 75C, a development device 76C, a cleaning unit 77C, and a non-illustrated discharging unit are arranged around the photoconductive drum 5C, and a charging device 75K, a development device 76K, a cleaning unit 77K, and a non-illustrated discharging unit are arranged around the photoconductive drum 5K. On each of the photoconductive drums 5Y, 5M, 5C, and 5K, image forming processes such as a charging process, an exposure process, a development process, a primary transfer process, and a cleaning process are performed, and as a result respective single color toner images are formed on the photoconductive drums 5Y, 5M, 5C, and 5K.

The elements or components of the image forming devices 4M, 4C, 4Y, and 4K are similar in structure and function to each other, except that the image forming devices 4M, 4C, 4Y, and 4K have different colors of toner, and therefore are also referred to as the image forming device 4 in a singular form.

Figure 3:
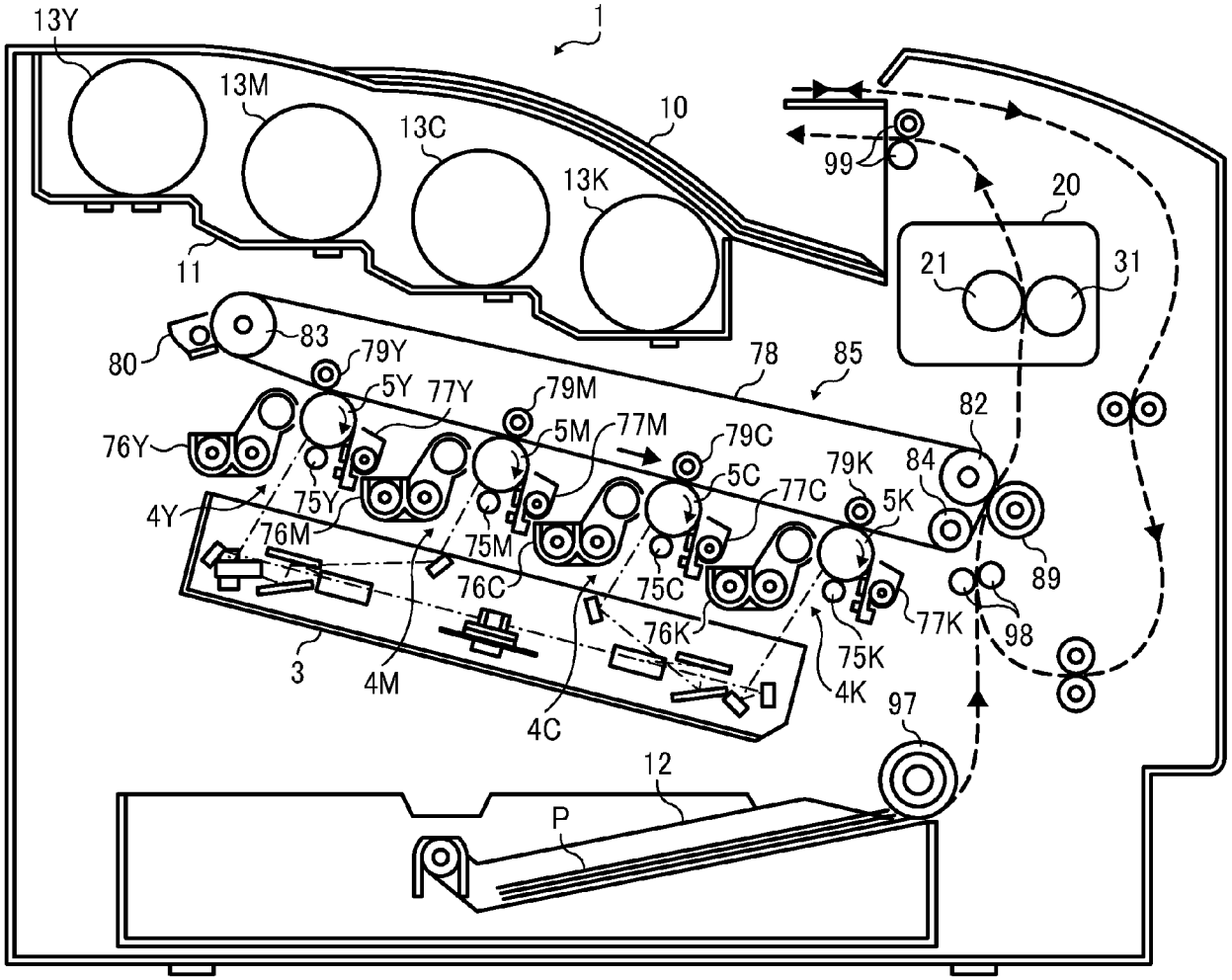
FIG. 3 is a schematic diagram illustrating an image forming apparatus according to a first embodiment of the present invention.

In the charging process, the photoconductive drum 5 is rotated by a non-illustrated drive motor in a clockwise direction in FIG. 3 and the surface of the photoconductive drum 5 is uniformly charged at the charging unit 75.

In the exposure process, the charged surface of the photoconductive drum 5 reaches a position to which a laser light beam is emitted from an exposure unit 3 so that an electrostatic latent image corresponding to the respective single toner color is formed thereon.

In the development process, the surface of the photoconductive drum 5 arrives at a position opposite to the development device 76 where the electrostatic latent image is developed into a visible toner image.

In the primary transfer process, the surface of the photoconductive drum 5 arrives at a position opposite to the intermediate transfer belt 78 and primary transfer bias rollers 79Y, 79M, 79C, and 79K where the toner image formed on the surface of the photoconductive drum 5 is transferred onto the developed onto the surface of the intermediate transfer belt 78. At this time, residual toner remains on the surface of the photoconductive drum 5.

In the cleaning process, the surface of the photoconductive drum 5 reaches a position opposite to the cleaning unit 77 where the residual toner remaining on the surface of the photoconductive drum 5 is removed by a cleaning blade included in the cleaning unit 77 and collected mechanically.

Finally, the surface of the photoconductive drum 5 reaches a position opposite to a non-illustrated discharging unit where a residual potential remaining on the photoconductive drum 5 is removed.

Thus, a series of image forming processes performed on the photoconductive drum 5 completes.

Thereafter, the toner images formed on the surfaces of the photoconductive drums 5 are sequentially transferred onto the intermediate transfer belt 78 so that a composite color image is formed on the intermediate transfer belt 78, which is a secondary transfer process.

Here, an intermediate transfer unit 85 includes an intermediate transfer belt 78, the primary transfer bias rollers 79Y, 79M, 79C, and 79K, a secondary transfer backup roller 82, a cleaning backup roller 83, a tension roller 84, and an intermediate transfer cleaning unit 80.

The intermediate transfer belt 78 is supportably wound around the secondary transfer backup roller 82, the cleaning backup roller 83, and the tension roller 84 with tension and is rotated with rotation of the secondary transfer backup roller 82 in a direction indicated by arrow in FIG. 3.

The primary transfer bias roller 79 (i.e., the primary transfer bias rollers 79Y, 79M, 79C, and 79K) and the photoconductive drum 5 (i.e., the photoconductive drums 5Y, 5M, 5C, and 5K) interpose the intermediate transfer belt 78 therebetween to form a primary transfer nip contact portion. The primary transfer bias roller 79 is applied with a transfer bias that has an opposite polarity to the toner.

The intermediate transfer belt 78 travels in a direction indicated by arrow in FIG. 3, and passes the respective primary transfer nip contact portions of the primary transfer bias rollers 79Y, 79M, 79C, and 79K sequentially. With this action, the respective single toner images formed on the surfaces of the photoconductive drums 5Y, 5M, 5C, and 5K are sequentially transferred onto the surface of the intermediate transfer belt 78 to form a composite toner image. The composite toner image on the intermediate transfer belt 78 comes to a position opposite to a secondary transfer roller 89. At this position, the secondary transfer backup roller 82 and the secondary transfer roller 89 interpose the intermediate transfer belt 78 therebetween to form a secondary transfer nip contact portion. The four-color composite toner image formed on the surface of the intermediate transfer belt 78 is transferred onto the recording medium P that is conveyed to the secondary transfer nip contact portion. At this time, non-transferred residual toner remains on the surface of the intermediate transfer belt 78. When the intermediate transfer belt 78 reaches the position near the intermediate transfer cleaning unit 80, the non-transferred residual toner on the intermediate transfer belt 78 is removed and collected.

With this action, the series of transfer processes performed on the intermediate transfer belt 78 completes.

The recording medium P conveyed to the secondary transfer nip contact portion has traveled from a sheet feeding unit 12 disposed at the lower part of the image forming apparatus 1 via a sheet feed roller 97, a pair of registration rollers 98, and so forth. The sheet feeding unit 12 accommodates a stack of recording media including the recording medium P such as a transfer sheet. When the sheet feed roller 97 is rotated in a direction counterclockwise to FIG. 3, an uppermost recording medium P is fed toward the rollers of the pair of registration rollers 98. The recording medium P conveyed to the pair of registration rollers 98 temporarily stops at the nip contact portion formed by the non-rotated pair of registration rollers 98. Then, the pair of registration rollers 98 rotates in synchronization with movement of the four-color toner image on the intermediate transfer belt 78, and the recording medium P travels toward the secondary transfer nip contact portion. By so doing, a desired color image is transferred onto the surface of the recording medium P. Then, the desired composite color image is transferred onto the recording medium P at the secondary transfer nip contact portion and the recording medium P is then conveyed by a fixing device 20. At the fixing device 20, the composite color image on the recording medium P is fixed to the recording medium P by application of heat and pressure. Then, the recording medium P is discharged by a pair of discharging rollers 99 to the outside of the image forming apparatus 1 and is stacked on a stacker 10 sequentially as an output image.

Figure 4:
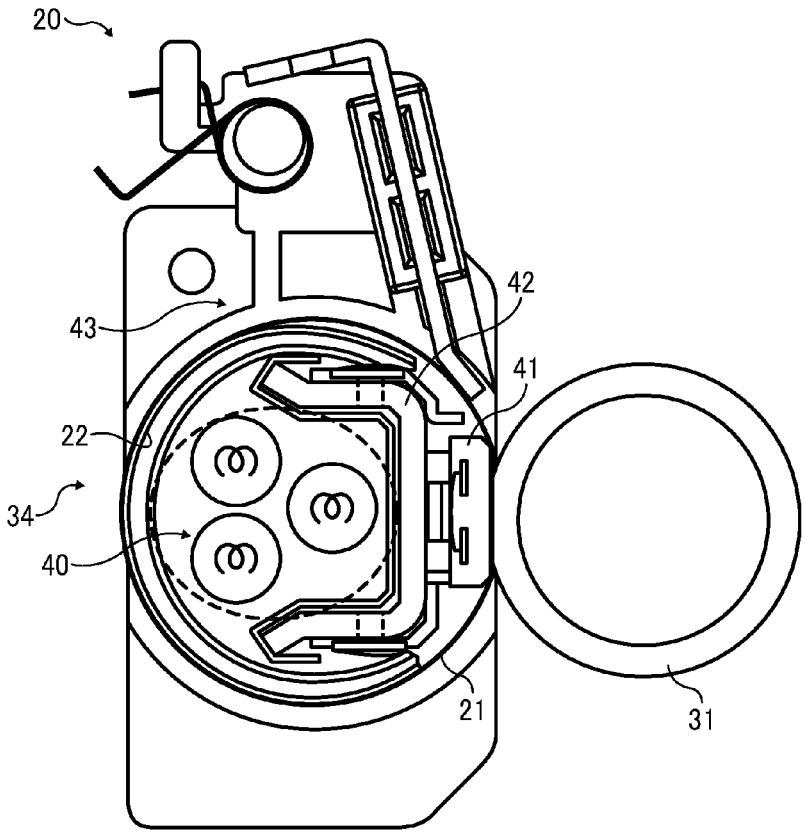
FIG. 4 is a schematic cross-sectional view illustrating an example of a fixing device according to the first embodiment of the present invention, includable in the image forming apparatus of FIG. 3.

Next, a description is given of a configuration of the fixing device 20 with reference to FIG. 4.

As a first example, a fixing device 20 of FIG. 4 includes a pressure roller 31 serving as a pressure rotary member, a fixing belt 21, and a metallic pipe 22 that is disposed in the vicinity of an inner circumferential surface of the fixing belt 21. In FIG. 4, halogen heaters are used as heat sources 40 to heat the metallic pipe 22.

Figure 5:
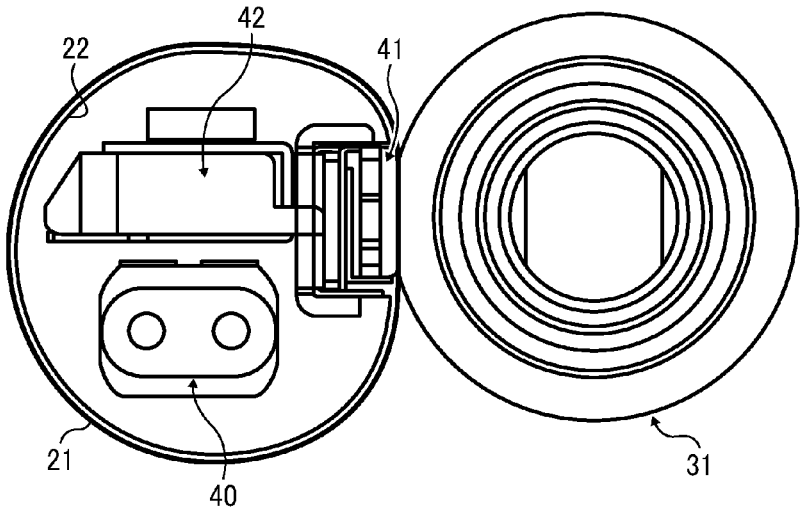
FIG. 5 is a schematic cross-sectional view illustrating another example of the fixing device according to the first embodiment of the present invention, includable in the image forming apparatus of FIG. 3.

On the inner circumferential surface of the fixing belt 21 illustrated in FIG. 4, a nip forming member 41 is supported by the metallic pipe 22. The nip forming member 41 is configured to be slidable with the inner circumferential surface of the fixing belt 21 directly or via a slide sheet. In the configuration of the fixing device 20 illustrated in FIG. 4, the nip contact portion has a U shape. However, the shape of the nip contact portion is not limited thereto. For example, the nip contact portion can employ a flat shape as illustrated in FIG. 5, a concave or other shape. In the fixing device 20 illustrated in FIG. 4, however, the discharging direction of the leading edge of the recording medium P inclines to the pressure roller 31, and accordingly separation performance is improved when the nip contact portion is U shaped, which prevents paper jams. Accordingly, the U-shaped nip contact portion is preferable.

The pressure roller 31 includes a hollow metallic roller with an elastic layer and a release layer. The elastic layer is made of a silicone rubber. The release layer is made of PFA or PTFE, for example, and provided on the outer circumferential surface of the elastic layer to have a good releasing performance. The pressure roller 31 is driven to rotate by a not-illustrated drive source, such as a motor, provided to the image forming apparatus 1. When the pressure roller 31 is driven to rotate, drive force of the pressure roller 31 is transmitted to the fixing belt 21 in the nip contact portion, and thereby the fixing belt 21 is driven to rotate.

The pressure roller 31 is pressed contact with the fixing belt 21 by a non-illustrated biasing member such as a spring. In the area of contact between the pressure roller 31 and the fixing belt 21, the elastic layer of the pressure roller 31 deforms to form a nip contact portion having a predetermined width along a sheet feeding direction.

The pressure roller 31 can be a solid bar. However, since a hollow-shaped roller can reduce the heat capacity, and therefore it is preferable the pressure roller 31 has a hollow shape. Further, since the pressure roller 31 is hollow, a heat source, such as a halogen heater, etc., can be disposed inside the pressure roller 31.

The silicone rubber layer can be replaced with solid rubber. However, if the pressure roller 31 does not have a heater therein, a sponge rubber can be used alternatively because the sponge rubber can increase heat retention ability to prevent taking heat from the fixing belt 21.

The fixing belt 21 is a sleeve-shaped belt or a film including a metal such as nickel, stainless steel, etc. or a resin material such as polyimide, etc. On the outer circumferential side of the fixing belt 21, a releasing layer such as tetrafluoroethylene-par fluoroalkyl vinyl ether copolymer (PFA) or polytetrafluoroethylene (PTFE) and the like is provided. The releasing layer has releasing performance so that toner does not adhere thereto. Further, an elastic layer made of rubber, such as silicone rubber may intervene between a base member and the releasing layer of PFA or PTFE. When the elastic layer is not present, the heat capacity is reduced and the fixing ability is enhanced. On the other hand, however, an unfixed image is crushed to be fixed, fine unevenness on the surface of the fixing belt 21 is transferred onto an image and unevenness of gloss in an orange peel state (e.g., an orange peel image) remains in the solid image. To further effectively prevent such skin-like glossy irregularity, the elastic rubber preferably has a given thickness, for example 100 μm or more. As the elastic layer deforms, the fine unevenness on the surface of the fixing belt 21 is absorbed, thereby improving the orange peel image.

The metallic pipe 22 is made of a metal such as aluminum, iron, stainless steel, and the like. As illustrated in FIG. 4, the metallic pipe 22 is formed into a substantially C-shaped member in cross-section having an opening at a position corresponding to the nip forming member 41. However, the shape of the metallic pipe 22 is not limited thereto and can be a substantially square member or other members having other shapes in cross-section. The metallic pipe 22 includes a nip supporting member 42 inside to support the nip forming member 41.

The configuration of the nip supporting member 42 prevents the nip forming member 41 from being bent by the pressure applied by the pressure roller 31, thereby maintaining a uniform nip width in the axial direction of the pressure roller 31.

The nip supporting member 42 and the nip forming member 41 are fixed and positioned by a flange 43 at both end portions thereof. The flange 43 functions as a moving guide for holding and guiding both end portions of the fixing belt 21. When the nip supporting member 42 is heated by radiant heat generated by the halogen heaters 40 and so forth, excessive heating can be prevented by applying heat insulation of, or giving a mirror-finish to, the surface of the nip supporting member 42, thereby preventing unnecessary energy consumption.

In FIG. 4, halogen heaters are employed as the heat sources 40 for heating the metallic pipe 22. However, the heat source 40 is not limited thereto. For example, the heat source 40 can employ induction heating, resistance heating element, carbon heater and the like.

The fixing belt 21 rotates along with rotation of the pressure roller 31. Specifically, as illustrated in FIG. 4, the pressure roller 31 is configured to be driven to rotate by a non-illustrated drive source and the driving force of the pressure roller 31 is transmitted to the fixing belt 21 in the nip contact portion, thereby rotating the fixing belt 21. While being sandwiched in the nip contact portion, the fixing belt 21 is guided by the flange 43 in an area other than the nip contact portion so that the fixing belt 21 can remain at a predetermined distance from the heat sources 40. Lubricant such as silicone oil or fluorine grease may be applied to the interface between the fixing belt 21 and the metallic pipe 22. Accordingly, the above-described configuration can provide an inexpensive fixing device with a quick warm-up time and a stable temperature of the entire fixing belt 21.

As another configuration applicable to the present invention, a fixing device without the metallic pipe 22 can be used. By not using the metallic pipe 22, the heat sources 40 can directly heat the fixing belt 21, and therefore a shorter warm-up time can be achieved, thereby obtaining good energy conservation.

Next, a description is given of details of the first embodiment.

Figure 6:
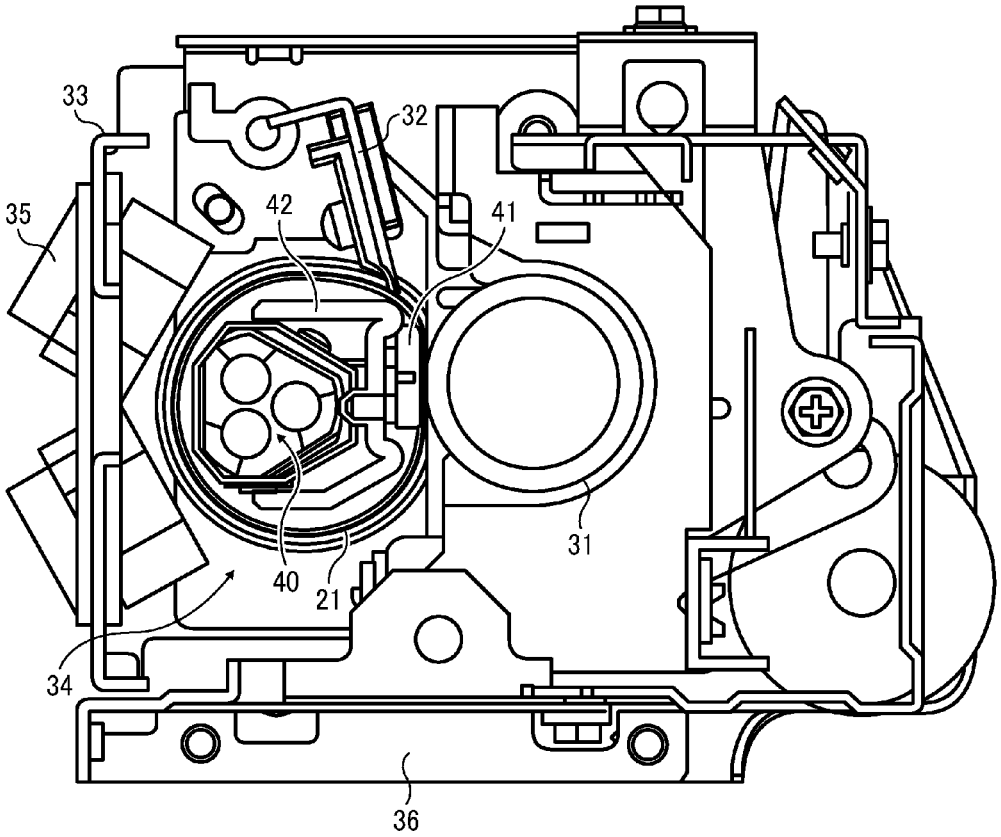
FIG. 6 is a schematic cross-sectional view illustrating the fixing device according to the first embodiment of the present invention, includable in the image forming apparatus of FIG. 3.

As illustrated in FIG. 6, the fixing belt 21 that is a sleeve belt without a driving shaft is slidably supported by a flange 43 having a groove at the inner surface of both ends. A separator 32 is supported by fitted to the groove of the flange 43. The nip forming member 41 disposed inside the loop of the fixing belt 21 is supported by the nip supporting member 42. The nip supporting member 42, the flange 43, and the heat sources 40 are all supported by a belt unit stay 33 that is supported by the frame 36 of the fixing device 20. The fixing belt 21, the nip forming member 41, the nip supporting member 42, and the heat sources 40 form a belt unit 34.

Figure 7:
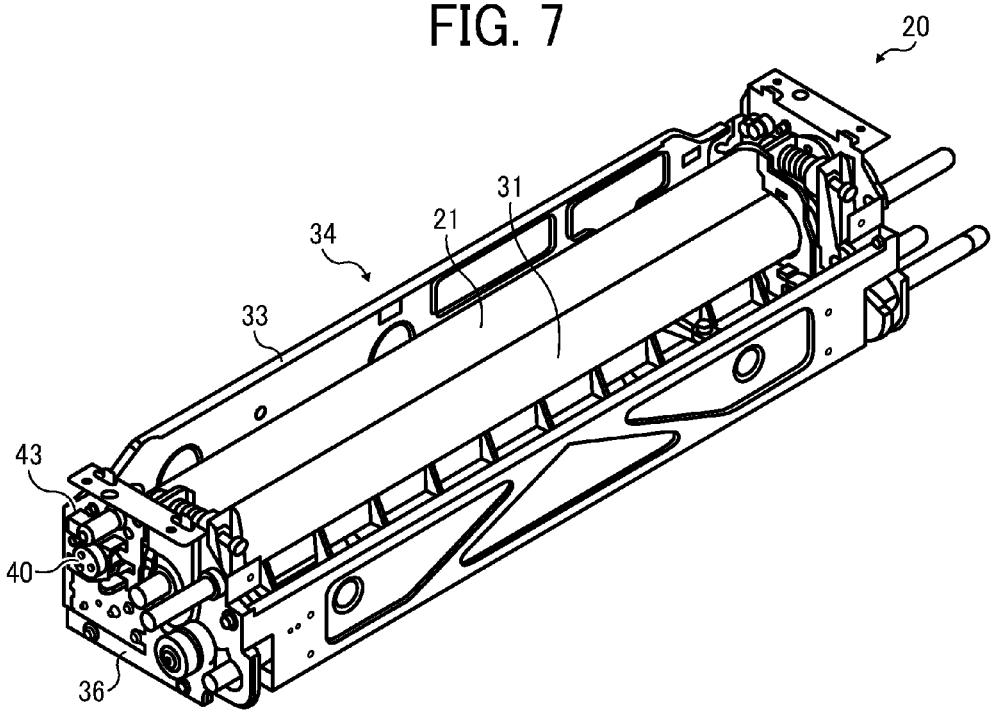
FIG. 7 is a schematic perspective view illustrating the fixing device according to the first embodiment of the present invention, includable in the image forming apparatus of FIG. 3.
Figure 8:
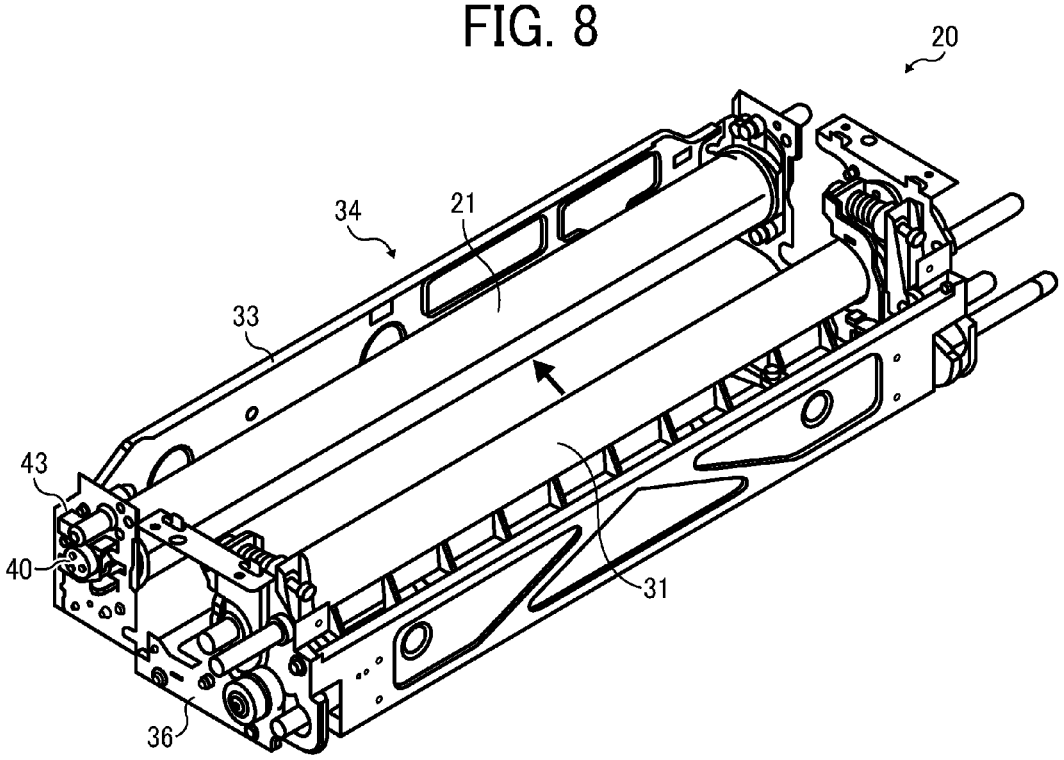
FIG. 8 is a schematic perspective view illustrating the fixing device according to the first embodiment of the present invention, in a state of disassembly.

FIGS. 7 and 8 are perspective views illustrating the fixing device 20 viewed from the pressure roller 31.

Figure 9:
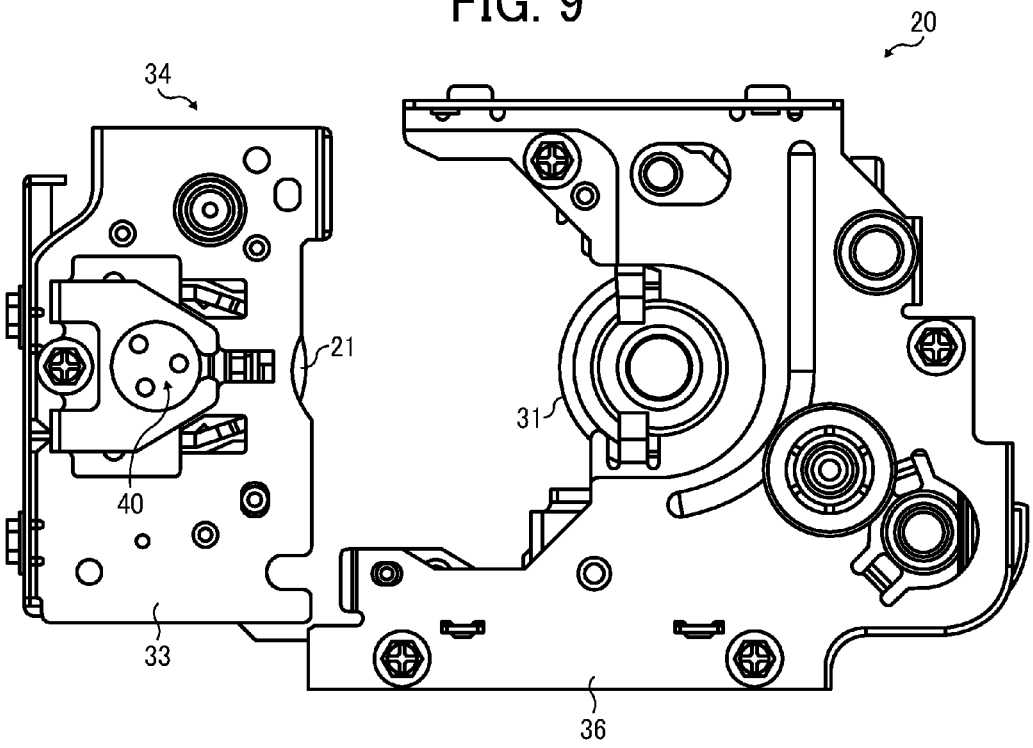
FIG. 9 is a schematic side view illustrating the fixing device according to the first embodiment of the present invention, in a state of disassembly.

In the first embodiment of the present invention, the fixing device 20 is fixed and positioned to the image forming apparatus 1 by screwing the belt unit stay 33 to the frame 36 fixed to the image forming apparatus 1. To remove the belt unit 34 from the frame 36 for replacement, the belt unit stay 33 can be detached from the frame 36 easily by unscrewing the belt unit stay 33 from the frame 36, as illustrated in FIGS. 8 and 9.

Then, the separator 32 is removed from the belt unit stay 33 detached from the frame 36. As previously described, the separator 32 is just fitted to the groove of the flange 43, and therefore can be removed from the belt unit stay 33 easily.

Figure 10:
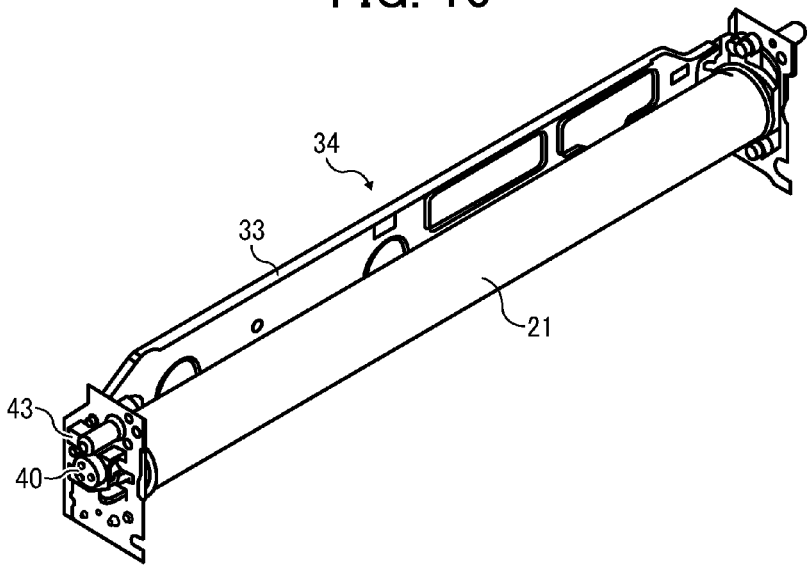
FIG. 10 is a schematic perspective view illustrating a belt unit according to the first embodiment of the present invention, included in the fixing device of the image forming apparatus of FIG. 3.

Further, in the first embodiment of the present invention, electrical parts and/components such as the heat sources 40, temperature sensors, drawer connectors, etc., are integrally supported by an electric parts supporting unit 35 (see FIG. 6). The electric parts supporting unit 35 can be easily removed by unscrewing it from the belt unit stay 33. Accordingly, the belt unit 34 can be completed separated from the other units and components of the image forming apparatus 1, as illustrated in FIG. 10. As a result, inadvertent contact with the fixing belt 21 and glass tubes of the heat sources 40, which are likely to be damaged or broken during replacement, can be prevented. Moreover, the positions of the fixing belt 21 and the heat sources 40 with respect to the belt unit stay 33 are fixed, thereby facilitating replacement of the belt unit 34 reliably, without damaging or breaking the fixing belt 21 and/or the heat sources 40. Accordingly, this configuration can achieve a reduction in the warm-up time of the fixing unit 20 and the image forming apparatus 1 and a cost-effective replacement of the belt unit 34.

After the replacement, the user attaches the separator 32 and the electric parts supporting member 35 to the belt unit 34 held by the belt unit stay 33, and installs the units in the reverse order of removal of the belt unit 34 from the fixing device 20.

Figure 11:
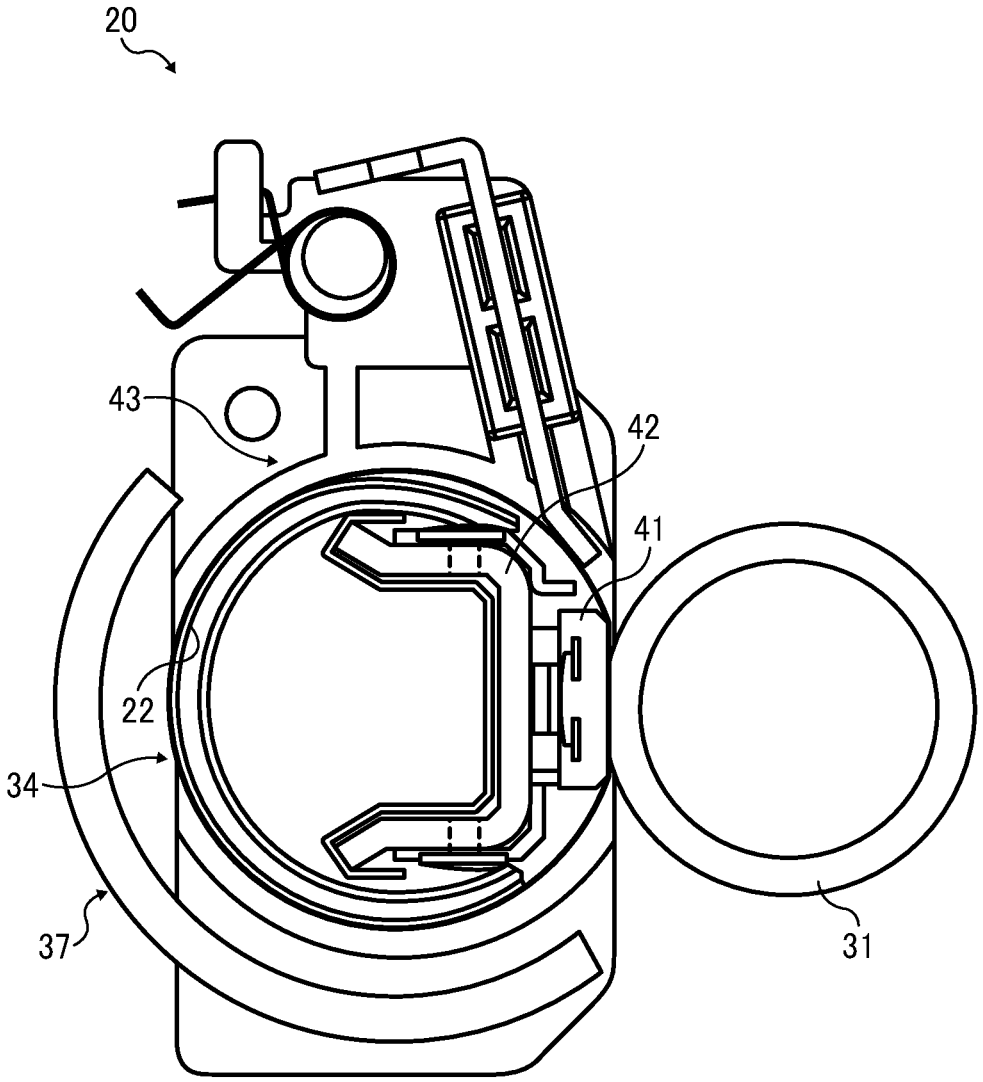
FIG. 11 is a cross-sectional view illustrating a fixing device according to a second embodiment of the present invention.

In the first embodiment of the present invention, a halogen heater is employed for a heat source. However, the configuration of the fixing device according to the present invention is not limited thereto. For example, a second embodiment of the present invention can provide a configuration including a ceramic heater at the nip contact portion, a configuration including a flat heater that is flexible and fixedly attached to an inner surface of a heating member, and a configuration including an induction heating (1H) heater 37 as illustrated in FIG. 11.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A fixing device comprising:

a frame;

a belt unit including a rotatable elastic endless belt having a sleeve shape and a nip forming member disposed contactable against an inner surface of the endless belt, the belt unit being without a driving shaft;

a pressing member, disposed in the frame, to form a nip contact portion through which a recording medium passes by pressing against the nip forming member via the endless belt;

a flange to hold the belt unit;

a belt unit stay provided on the belt unit to support the nip forming member, the endless belt, and the flange, the belt unit being configured to be replaced by removing the belt unit stay from the frame of the fixing device; and an electric parts supporting unit to support electrical parts disposed on the electric parts supporting unit, the electric parts supporting unit being configured to be removed from the belt unit stay while the belt unit is in a state that is configured to carry out a fixing operation.

2. The fixing device according to claim 1, wherein the belt unit comprises a heater therein to heat the endless belt, wherein the heater is held by the belt unit stay.

3. The fixing device according to claim 2, wherein the belt unit further comprises a nip supporter to prevent deformation of the nip forming member due to pressure exerted by the pressing member, wherein the nip supporter is held by the belt unit stay.

4. The fixing device according to claim 1, wherein the belt unit comprises a nip supporter to prevent deformation of the nip forming member due to pressure exerted by the pressing member, wherein the nip supporter is held by the belt unit stay.

5. An image forming apparatus comprising:

an image carrier to form an image on a surface thereof;

a transfer unit to transfer the image onto a recording medium; and the fixing device according to claim 1.

6. The fixing device according to claim 1, wherein the flange acts as a moving guide for holding and guide both end portion of the endless belt.

7. The fixing device according to claim 1, wherein the endless belt is slidably supported by the flange having a groove at an inner surface of both ends.

8. The fixing device according to claim 1, wherein the endless belt is guided by the flange in an area other than the nip contact portion so that the endless belt can remain at a set distance from a heater.

9. The fixing device according to claim 1, wherein belt unit stay is supported by the frame of the fixing device.

10. The fixing device according to claim 9, wherein the belt unit stay is attached/detached from the frame.

11. The fixing device according to claim 1, wherein the separator is fitted to the flange.

12. The fixing device according to claim 1, further comprising a separator removable from the belt unit stay.

13. The fixing device according to claim 1, wherein, after replacement of the belt unit, the separator and the electric parts supporting unit are re-attached to the belt unit stay in reverse order of removal of the belt unit from the fixing device.

14. The fixing device according to claim 1, wherein the belt unit is configured to be replaced by unscrewing the belt unit stay from the frame of the fixing device.

15. A fixing device comprising:

a belt unit including a rotatable endless in a loop, and a nip forming member disposed contactable against an inner surface of the rotatable endless belt;

a pressing member to form a nip contact portion through which a recording medium passes by pressing against the nip forming member via the rotatable endless belt; a flange to hold the belt unit;

a belt unit stay to hold the flange such that the belt unit is removable by removing the belt unit stay; and an electric parts supporting unit to support electrical parts, wherein the belt unit is removable from the fixing device without contacting the rotatable endless belt, and wherein the electric parts supporting unit is disposed outside a circumference of the rotatable endless belt, and is removable from the belt unit stay of which the belt unit is supported by the belt unit stay.

16. The fixing device according to claim 15, wherein the rotatable endless belt includes a heater lamp disposed inside the loop.

17. The fixing device according to claim 15, wherein the electric parts include at least one of a heat source, a temperature sensor, and a drawer connector.

18. The fixing device according to claim 15, wherein the belt unit further comprises a nip supporter to prevent deformation of the nip forming member due to pressure exerted by the pressing member, and wherein the nip supporter is held by the belt unit stay.

19. The fixing device according to claim 15, wherein the rotatable endless belt is guided by the flange in an area other than the nip contact portion such that the endless belt remains at a predetermined distance from a heater.

20. An image forming apparatus comprising:

an image carrier to form an image on a surface thereof;

a transfer unit to transfer the image onto the recording medium; and the fixing device according to claim 18.

* * * * *